US010683666B1

(12) United States Patent
Mouriz et al.

(10) Patent No.: US 10,683,666 B1
(45) **Date of Patent: *Jun. 16, 2020**

(54) METHOD FOR COVERING ROOF WITH SHRINK WRAP

(71) Applicant: STRUCTURAL WRAP, LLC, Miami, FL (US)

(72) Inventors: Christopher M. Mouriz, Miami, FL (US); Spiro Naos, Miami, FL (US); Larry J. Bond, Miami, FL (US)

(73) Assignee: STRUCTURAL WRAP, LLC, Miami, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/681,421

(22) Filed: Nov. 12, 2019

Related U.S. Application Data

(63) Continuation-in-part of application No. 16/294,554, filed on Mar. 6, 2019, now Pat. No. 10,472,827.

(51) Int. Cl.
*E04D 5/06* (2006.01)
*E04D 5/14* (2006.01)

(52) U.S. Cl.
CPC ..... *E04D 5/06* (2013.01); *E04D 5/144* (2013.01)

(58) Field of Classification Search
CPC ..... E04D 5/146; E04D 5/142; E04D 15/04; E04D 5/06; E04D 2015/042
See application file for complete search history.

(56) References Cited

U.S. PATENT DOCUMENTS 7,793,478 B2 * 9/2010 Ehsani ..... E04D 5/142 52/409
9,822,536 B2 * 11/2017 Lennox ..... E04G 21/28
2005/0217202 A1 * 10/2005 Crook ..... E04H 9/14 52/782.1

OTHER PUBLICATIONS

WikiHow "How to Tarp a Roof" http://www.wikihow.conn/Tarp-a-Roof https://web.archive.org/web/20130625111700/http://www.wikihow.com/Tarp-a-Roof Jun. 25, 2013 (Year: 2013).*
"How to Tarp a Tile Roof" Insurance General Contractors https://temporaryrepair.com/blog/2013/8/28/how-to-tarp-a-tile-roof Aug. 28, 2013 (Year: 2013).*

* cited by examiner

*Primary Examiner* — Patrick J Maestri
(74) *Attorney, Agent, or Firm* — Mark Terry

(57) ABSTRACT

A system and method for temporary protection of a damaged roof is provided. The method includes draping a strip of the impermeable membrane over the roof, wherein the end of the strip overhangs a fascia of eaves of the roof, placing a piece of construction material in a horizontal position under the end of the strip, cutting the end of the strip as follows: a horizontal cut and two vertical cuts of the construction material, such that a resulting shape of the end of the strip is substantially commensurate with the construction material, fastening the construction material to the end of the strip, rolling the construction material at least one full turn in the end of the strip, attaching the construction material to the fascia of the eaves of the roof, and repeating the steps above until the entire roof is covered in the impermeable membrane.

19 Claims, 7 Drawing Sheets

METHOD FOR COVERING ROOF WITH SHRINK WRAP

CROSS-REFERENCE TO RELATED APPLICATIONS

This application claims priority to, and is a continuation in part of, application Ser. No. 16/294,554 filed Mar. 6, 2019 and titled "Method for Covering Roof with Shrink Wrap." The subject matter of application Ser. No. 16/294,554 is hereby incorporated by reference in its entirety.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

TECHNICAL FIELD

The technical field relates generally to the field of residential and commercial structural maintenance and, more specifically, relates to the field of roof maintenance for residential and commercial structures.

BACKGROUND

Maintenance is the process of ensuring that buildings and structures retain a good appearance and operate at optimum efficiency. Inadequate maintenance can result in decay, degradation and reduced performance and can affect health and threaten the safety of users, occupants and others in the vicinity. Building structure, and roofs in particular, are regularly subjected to harsh conditions including wind, rain, snow, heat, cold, and storms. Said conditions can cause damage to the roof, as well as the interior of the structure. For these reasons, roofs require regular maintenance to maintain optimum efficiency and continue to accomplish their design goals.

When roofs suffer significant damage, however, significant construction or refurbishing services may be necessary. This may require a long period of time to accomplish, as contractors must be found and assigned to the job, permits must be obtained, and money must be allocated and transferred. During this period time, the roof cannot be left unattended, as the roof the contents of the structure may suffer further damage. In these situations, therefore, temporary remedial or protective measures are necessary.

Various approaches to this problem have been proposed. A well-known approach to this problem is to attach a temporary water-impermeable membrane to the exterior of the roof to prevent water from penetrating the roof while it remains damaged, also known as the blue tarp method. These approaches, however, are difficult and time-consuming to implement. The current approaches to the problem of applying a temporary membrane to a damaged roof do not address the issue of properly fitting the membrane to the roof size and shape. The current approaches also do not address the issue of fastening the ends or the perimeter of the membrane to the roof. Improper fitting of the membrane to the size and shape of the roof can result in a membrane that can be removed by strong winds or permit water to enter in between the membrane and the roof. Additionally, improper fastening of the ends, or perimeter of, the membrane, can result in a membrane that is too easily removed and allows water penetration. For these reasons, the current approaches to the problem of applying a temporary membrane to a damaged roof are inadequate.

Additionally, the current approaches to the problem of applying a temporary membrane to a damaged roof, including the blue tarp method, add holes to the top of the roof, which can cause further water leakage into the structure, and only last for up to 90 days. In fact, the Federal Emergency Management Agency, FEMA, even categorizes the blue tarp method as only a 30-day solution. Therefore, the current approaches to the problem of applying a temporary membrane to a damaged roof are temporary at best.

Therefore, a need exists to overcome the problems with the prior art as discussed above, and particularly for a more efficient way of applying temporary remedial or protective measures onto a damaged roof.

SUMMARY

A system and method for temporary protection of a damaged roof is provided. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, a system and method for temporary protection of a damaged roof is provided that solves the above-described problems. The method includes draping a strip of the impermeable membrane over the roof, wherein the end of the strip overhangs a fascia of eaves of the roof, placing a rigid, elongated piece of construction material in a horizontal position under the end of the strip that overhangs the fascia of the eaves of the roof, such that the construction material is placed below the fascia of the eaves of the roof, cutting the end of the strip as follows: 1) a horizontal cut below a position of the construction material, 2) a vertical cut to the left of the construction material, and 3) a vertical cut to the right of the construction material, such that a resulting shape of the end of the strip is substantially commensurate with the construction material, fastening the construction material to the end of the strip using a plurality of first fasteners, rolling the construction material at least one full turn in the end of the strip that overhangs the fascia of the eaves of the roof, attaching the construction material that was rolled in the end of the strip to the fascia of the eaves of the roof using a plurality of second fasteners, and repeating the steps above until the entire roof is covered in the impermeable membrane.

BRIEF DESCRIPTION OF THE DRAWINGS

The accompanying drawings, which are incorporated in and constitute a part of this disclosure, illustrate various example embodiments. In the drawings.

DETAILED DESCRIPTION

Figure 1:
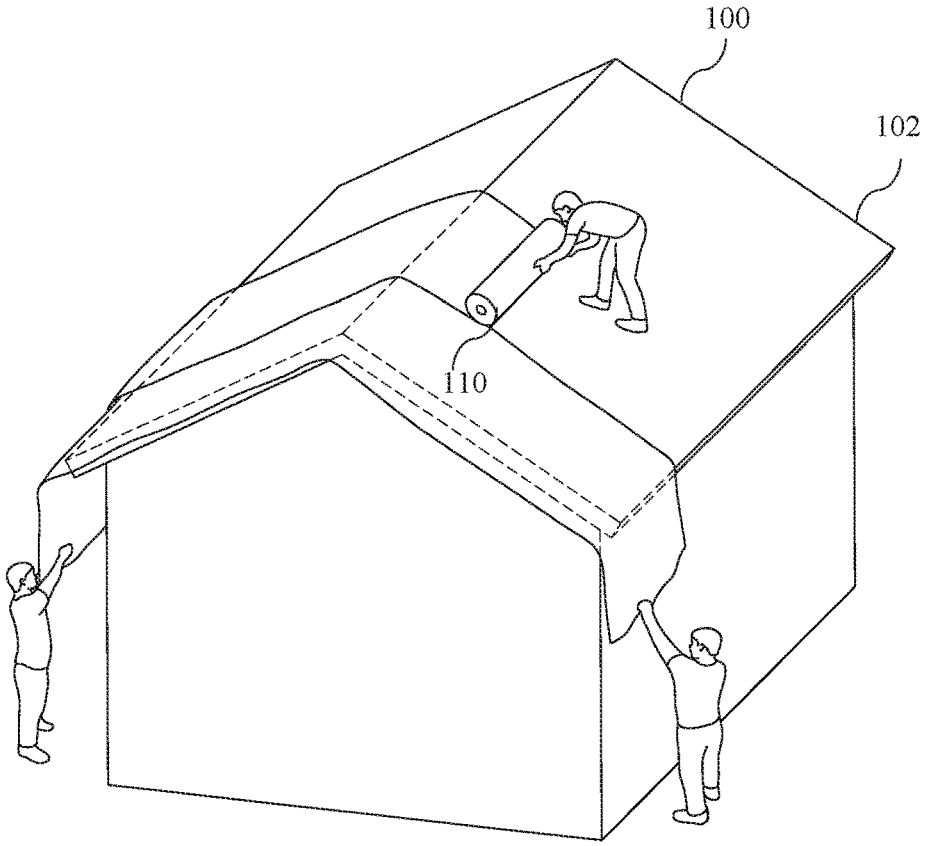
FIG. 1 is an illustration of a perspective view of a residential structure with a damaged roof, as the proposed system and method for temporary protection of a damaged roof is applied, according to an example embodiment.

The following detailed description refers to the accompanying drawings. Wherever possible, the same reference numbers are used in the drawings and the following description to refer to the same or similar elements. While embodiments of the claimed subject matter may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the claimed subject matter. Instead, the proper scope of the claimed subject matter is defined by the appended claims.

The claimed subject matter improves over the prior art by providing an economic, user-friendly and effective way of temporarily protecting a damaged roof, and the contents of the structure, from further damage. The claimed subject matter is further easy to learn for workers and time-saving to implement. The claimed subject matter further improves over the prior art by properly fitting the membrane to the roof size and shape and properly fastening the ends or the perimeter of the membrane to the roof. Proper fitting of the membrane to the size and shape of the roof results in a membrane that cannot be removed by strong winds or permit water to enter in between the membrane and the roof. Additionally, proper fastening of the ends, or perimeter of, the membrane, results in a membrane that is not easily removed and does not allow water penetration. Furthermore, the claimed subject matter does not introduce additional holes into the damaged roof and is a more than a temporary solution, as it can persist for periods of time longer than 90 days.

The accompanying drawings, which are incorporated in and constitute a part of this disclosure, illustrate various example embodiments. The claimed system and method for temporary protection of a damaged roof will now be described with respect to FIGS. 1 through 8. FIG. 1 is an illustration of a perspective view of a residential structure 100 with a damaged roof 102, as the proposed system and method for temporary protection of a damaged roof is applied, according to an example embodiment. FIG. 1 shows that the proposed system and method includes the application of an impermeable membrane to the damaged roof.

The proposed system utilizes a water impermeable membrane that may shrink when heat is applied. Namely, when heat is applied to the water impermeable membrane, the material shrinks tightly over whatever it is covering. Further, when heat is applied to the water impermeable membrane, the membrane may become partially liquid or tacky and may meld with a membrane of the same type. That is, when two pieces of said membrane are placed adjacent to one another and heat is applied, the two pieces of the membrane may meld together and become one integrated portion of water impermeable membrane. The water impermeable membrane may be used in a variety of thicknesses, clarities, strengths and shrink ratios. The water impermeable membrane may comprise polyolefin and may be a material made up of polymer plastic film. Polyolefin is a type of polymer produced from a simple olefin (also called an alkene) as a monomer. Other examples of materials used for the water impermeable membrane include PVC, polyethylene, polypropylene, EP/EVA/copolyester/EVA/EP (where EP is ethylene-propylene and EVA is ethylene-vinyl acetate copolymer) and other compositions.

The water impermeable membrane may be provided in rolls 110 of a certain width. In one embodiment, each roll 110 of the water impermeable membrane comprises a width of about 24 to 42 inches, with each roll provided from about 40 feet to about 120 feet of length of the water impermeable membrane. FIG. 1 shows that several rolls 110 of the impermeable membrane have been placed on top of the damaged roof 102 of the residential structure 100. Each roll 110 is unrolled on top of the damaged roof 102 in the same direction and the sides of each unrolled strip of impermeable membrane are placed adjacent to another unrolled strip of impermeable membrane, such that the sides of each unrolled strip are coupled with the sides of the unrolled strips adjacent, as described more fully below.

Figure 2:
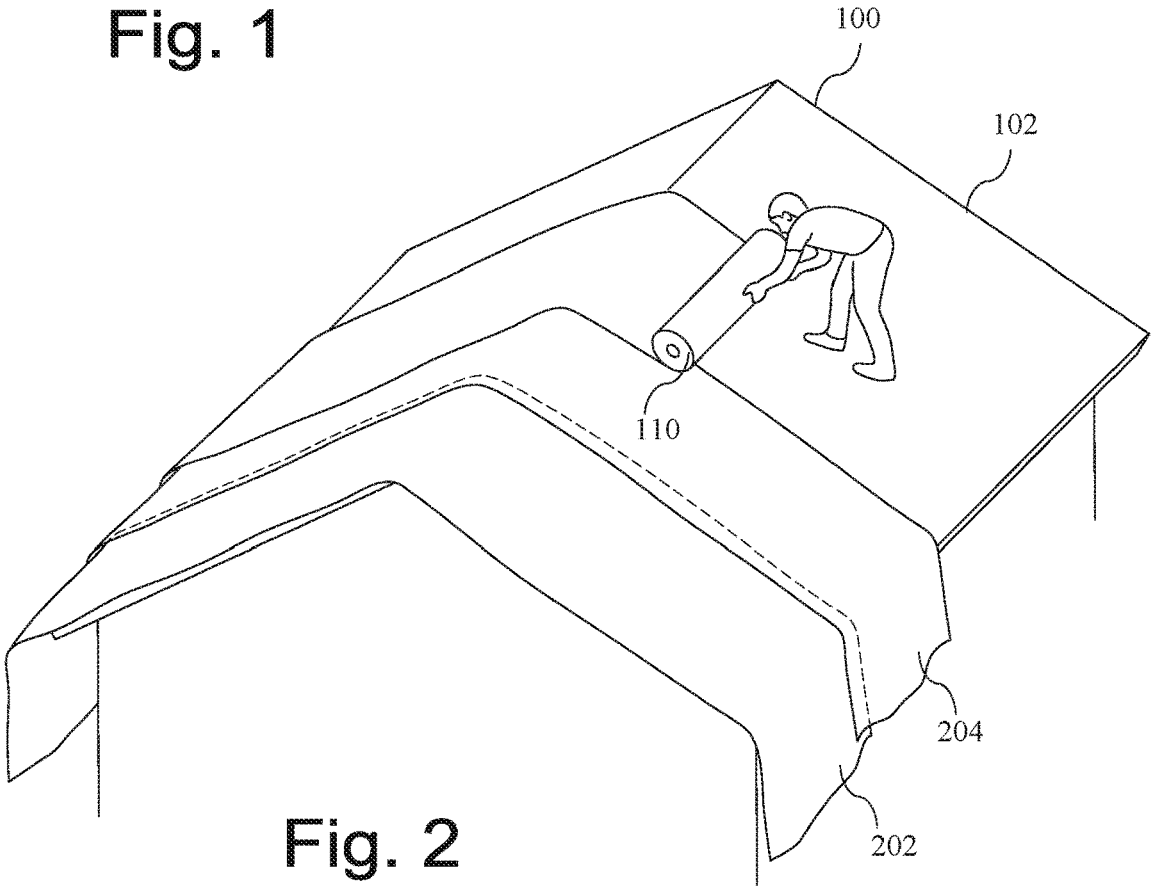
FIG. 2 is an illustration of a close-up perspective view of the residential structure with the damaged roof, as the proposed system and method for temporary protection of a damaged roof is applied, according to an example embodiment.

FIG. 2 is an illustration of a close-up perspective view of the residential structure 100 with the damaged roof 102, as the proposed system and method for temporary protection of a damaged roof is applied, according to an example embodiment. FIG. 2 shows multiple rolls 110 of the impermeable membrane have been placed on top of the damaged roof 102 of the residential structure 100 in order to protect said roof, and the contents of the residential structure 100, from further damage or decay from precipitation, wind, etc. FIG. 2 shows that each roll 110 is unrolled, either fully or partially, on top of the damaged roof 102 in the same direction. FIG. 2 also shows that the sides of each unrolled strip 202 of impermeable membrane are placed adjacent to another unrolled strip 204 of impermeable membrane. More specifically, FIG. 2 shows that the sides of each unrolled strip 202 of impermeable membrane are placed so as to overlap (by about 3 to 8 inches) with the sides of the adjacent unrolled strip 204 of impermeable membrane. In one embodiment, each unrolled strip 202 of impermeable membrane are placed so as to overlap with the sides of the adjacent unrolled strip 204 of impermeable membrane by exactly 3 inches. Subsequently, the sides of each unrolled strip are coupled with the sides of the unrolled strips adjacent, as described more fully below.

Figure 3:
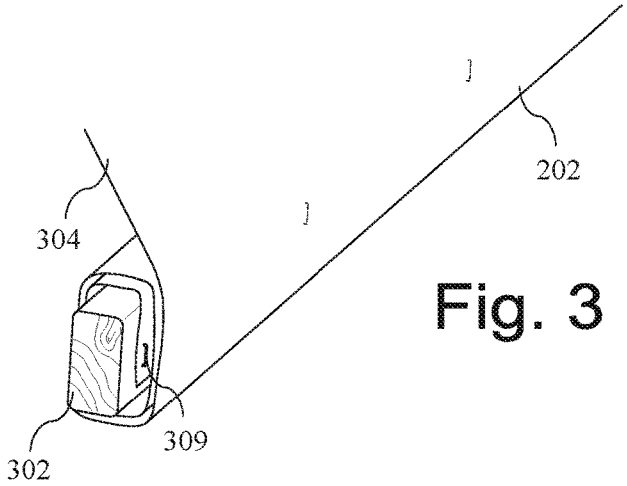
FIG. 3 is an illustration showing construction material in the process of being wrapped in the impermeable membrane, as the proposed system and method for temporary protection of a damaged roof is applied, according to an example embodiment.

FIG. 3 is an illustration showing construction material 302 in the process of being wrapped in the impermeable membrane 304, as the proposed system and method for temporary protection of a damaged roof is applied, according to an example embodiment. In FIG. 3, the construction material 302 is a piece of lumber, which is a type of wood that has been processed into beams and planks. A plank, i.e., a wood plank or plank of wood, is timber that is flat, elongated, and rectangular with parallel faces that are higher and longer than wide. Planks are usually more than 1½ in (38 mm) thick and are generally wider than 2½ in (64 mm). Planks can be any length and are generally a minimum of 2 in (51 mm) deep by 8 in (200 mm) wide, but planks that are 2 in (51 mm) by 10 in (250 mm) and 2 in (51 mm) by 12 in (300 mm) are more common. In one embodiment, the construction material 302 is a wood plank that measures 2 in ×4 in, 2 in ×6 in, 2 in ×8 in, or 2 in ×12 in. In one embodiment, the construction material 302 is a wood plank that measures 1'×2'×8'.

In other embodiments, the construction material 302 may be other items, such as portions of metal siding, portions of roof tile, etc. FIG. 3 shows the roll 110 of impermeable membrane has been unrolled to such a length that the end of the unrolled strip 202 overhangs the eaves of the damaged roof 102 of the residential structure. FIG. 3 shows that the end of the unrolled strip 202 (which was rolled around the construction material 302) has been attached to the construction material 302 via one or more fasteners 309, which is a staple. In one embodiment, T50 ⅜' galvanized steel staples are placed 4 inches apart on the end of the unrolled strip 202. In another embodiment, exactly 24 staples are placed on the end of the unrolled strip 202 per instance (or plank) of construction material 302, so as to attach the unrolled strip to the construction material. Other types of fasteners may be used to attach the construction material 302 to the end of the unrolled strip 202, such as nails, clips, screws, etc. Also, adhesive may be used to attach the construction material 302 to the end of the unrolled strip 202. FIG. 3 shows that the construction material 302 has been wrapped in the end of the unrolled strip 202 in a clockwise 319 direction so that the open end of the roll faces downwards.

In an alternative embodiment, the construction material 302 is a flexible piece of plastic strip that is available in a coiled form in 50-foot coils. The plastic, which may be regrind plastic, is uncoiled for use as the construction material for attaching to the roof. The plastic strip is wrapped in the end of the unrolled strip 202 as described above, and the unrolled strip is attached to the plastic strip as described above. Said plastic strip is smaller than wood planks, easier to store, flexible for use in different shapes and allows work crews to work more efficiently.

Figure 4:
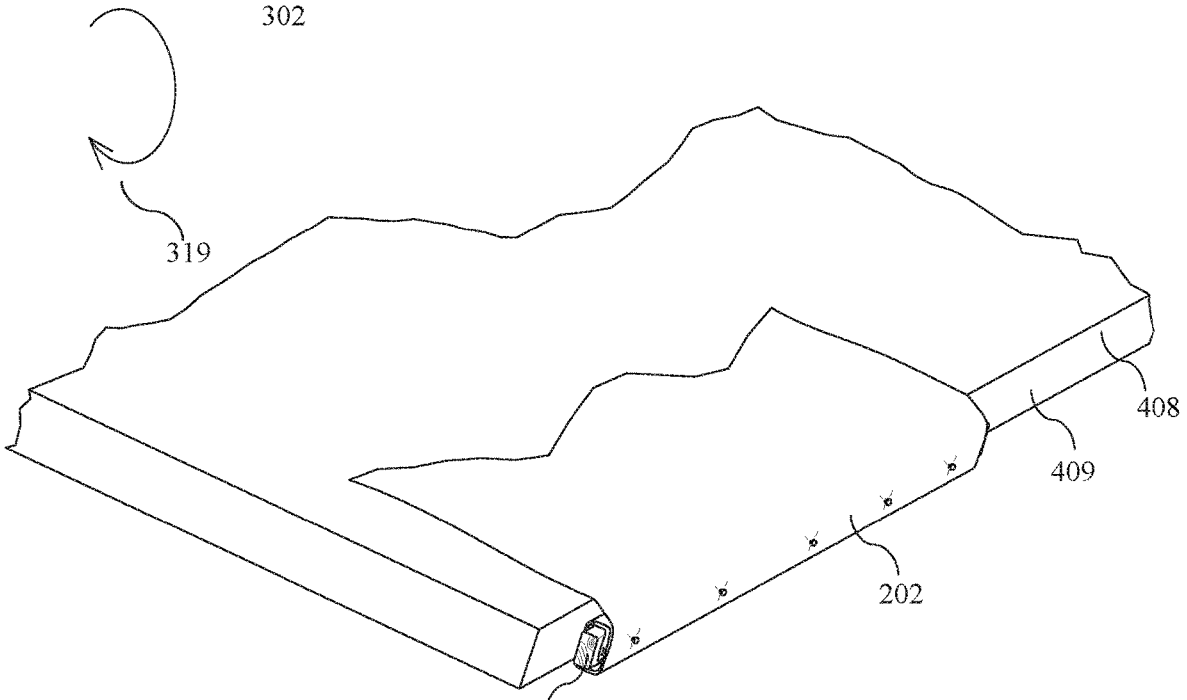
FIG. 4 is an illustration showing construction material completely wrapped in the impermeable membrane and attached to the damaged roof, as the proposed system and method for temporary protection of a damaged roof is applied, according to an example embodiment.

FIG. 4 is an illustration showing construction material 302 completely wrapped in the impermeable membrane 304 and attached to the damaged roof 102, as the proposed system and method for temporary protection of a damaged roof is applied, according to an example embodiment. FIG. 4 shows the roll 110 of impermeable membrane had been unrolled to such a length that the end of the unrolled strip 202 overhangs the eaves 409 of the damaged roof 102, so as to be applied to the construction material 302. FIG. 4 shows that the construction material 302 has been wrapped in the end of the unrolled strip 202, which overhangs the eaves 409 of the damaged roof 302. Note that the construction material 302 is attached to the vertical, outward-facing fascia 408 of the eaves of the roof. In one embodiment, each instance of the construction material 302 is spaced 4 inches apart from the next instance of the construction material on the fascia 408 of the eaves of the roof, around the entire perimeter of the roof. Through testing, the applicant discovered that less than 4 inches would result in a roof not being properly vented and more than 4 inches would not be secure (waterproof) enough.

In an alternative embodiment where the construction material 302 is a flexible piece of plastic strip, the plastic is uncoiled for use as the construction material for attaching to the roof, and the plastic strip is attached to the vertical, outward-facing fascia 408 of the eaves of the roof as described above.

Figure 5:
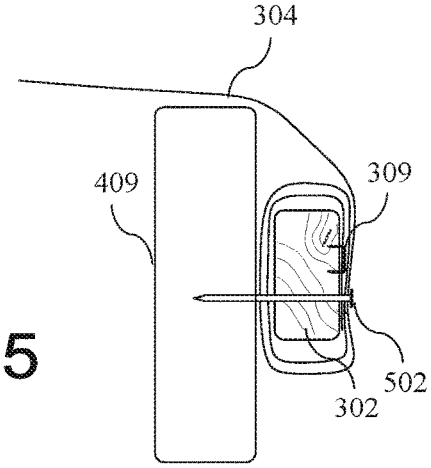
FIG. 5 is an illustration showing a cross-sectional view of construction material completely wrapped in the impermeable membrane and attached to the damaged roof, as the proposed system and method for temporary protection of a damaged roof is applied, according to an example embodiment.

FIG. 5 is an illustration showing a cross-sectional view of construction material 302 completely wrapped in the impermeable membrane 304 and attached to the damaged roof 102, as the proposed system and method for temporary protection of a damaged roof is applied, according to an example embodiment. FIG. 5 shows that the construction material 302 has been wrapped in the end of the unrolled strip 202, which overhangs the eaves 409 of the damaged roof 102. The construction material 302 may be wrapped such that the end of the unrolled strip 302 completely surrounds the construction material 1 time, 2 times, or 3-4 times. I.e., in one embodiment, construction material 302 is wrapped 1 time, 2 times, or 3-4 times in the end of the unrolled strip.

FIG. 5 shows that the end of the unrolled strip 202 (after wrapping the construction material 302) has been attached to the construction material 302 via a fastener 309, which is a staple. FIG. 5 further shows that the construction material 302 and the end of the unrolled strip 202 (which wraps around the construction material 302) has been attached to the eaves 409 of the roof via one or more fasteners 502, which is a nail. Other types of fasteners may be used to attach the construction material 302 and the end of the unrolled strip 202 to the eaves of the roof, such as clips, screws, etc. Also, adhesive may be used to attach the construction material 302 and the end of the unrolled strip 202 to the eaves of the roof. In one embodiment, the fastener 502 is a #10 3-inch polymer-coated exterior screw placed every 16 inches along the length of the construction material 302 and the end of the unrolled strip 202, so as to attach the construction material 302 and the end of the unrolled strip 202 to the fascia 408. If the fascia 408 consists of concrete, brick or block, then the fastener 502 is a ¼"×2¾" concrete anchor placed every 16 inches along the length of the construction material 302, so as to attach the construction material 302 and the end of the unrolled strip 202 to the fascia 408. In one embodiment, the fastener 502 is a 3"×0.120 galvanized nail deployed with a nail gun and placed every 16 inches along the length of the construction material 302 and the end of the unrolled strip 202, so as to attach the construction material 302 and the end of the unrolled strip 202 to the fascia 408. In another embodiment, exactly 6 nails or screws are placed along the length of the construction material 302 and the end of the unrolled strip 202, so as to attach the construction material 302 and the end of the unrolled strip 202 to the fascia 408.

In one embodiment, the method or process of attaching the ends of the unrolled strip 202 to the eaves of the damaged roof 102 occurs as follows. A first unrolled strip of the impermeable membrane is draped over the roof 102, wherein the end of the strip overhangs the eaves of the roof. Then, a wood plank is placed horizontally under the end of the strip that overhangs the eaves of the roof, such that the wood plank is placed below the eaves of the roof. The wood plank is placed far enough below the eaves of the roof such that when the wood plank is rolled up in the end of the strip (described below), the wood plank is at the height of the fascia of the eaves of the roof. Next, the left and right sides of the strip are cut vertically such that the strip is coextensive with a length of the wood plank. The end of the strip is also cut horizontally below the wood plank. That is, assuming the wood plank is placed horizontally so that it is parallel with the fascia of the eaves of the roof, a vertical cut is placed in the end of the strip on the left of the wood plank, a vertical cut in placed in the end of the strip on the right of the wood plank, and a horizontal cut is placed in the end of the strip below the wood plank.

In an alternative embodiment where the construction material 302 is a flexible piece of plastic strip (wherein the plastic is uncoiled for use as the construction material for attaching to the roof, and the plastic strip is attached to the vertical, outward-facing fascia 408 of the eaves of the roof), the plastic strip is placed horizontally under the end of the membrane strip that overhangs the eaves of the roof, such that the plastic strip is placed below the eaves of the roof. The plastic strip is placed far enough below the eaves of the roof such that when the plastic strip is rolled up in the end of the membrane strip (described below), the plastic strip is at the height of the fascia of the eaves of the roof. The left and right sides of the membrane strip are not necessarily cut vertically. The end of the membrane strip may be cut horizontally below the plastic strip. That is, assuming the plastic strip is placed horizontally so that it is parallel with the eaves of the roof, a horizontal cut is placed in the end of the membrane strip below the plastic strip. There is no need to cut the membrane strip vertically because the plastic strip may be extended beyond the left and right edges of the membrane strip.

Returning to the wood plank embodiment, the wood plank is fastened to the end of the strip using a plurality of staples. Next, the wood plank is rolled one full turn, two full turns, or three full turns in the end of the strip, such that the wood plank is at a height of the fascia of the eaves of the roof. Then, the wood plank that was rolled in the end of the strip is attached to the fascia of the eaves of the roof using a plurality of nails. Further, each strip of the impermeable membrane that has been draped over the roof is placed such that it overlaps at least three inches with each adjacent strip of the impermeable membrane that has been draped over the roof. The steps above are repeated until the entire roof is covered in the impermeable membrane. Finally, heat is applied using a heat source to a portion of each strip that overlaps an adjacent strip, so as to meld the portion of each strip with the adjacent strip (as described more fully below). Also, heat may be applied using a heat source to all or a portion of the impermeable membrane on the roof, so as to shrink the membrane for aerodynamic purposes (to reduce or eliminate the membrane blowing off in a wind) and for hydrodynamic purposes to aid in water running or falling off the roof.

Figure 6:
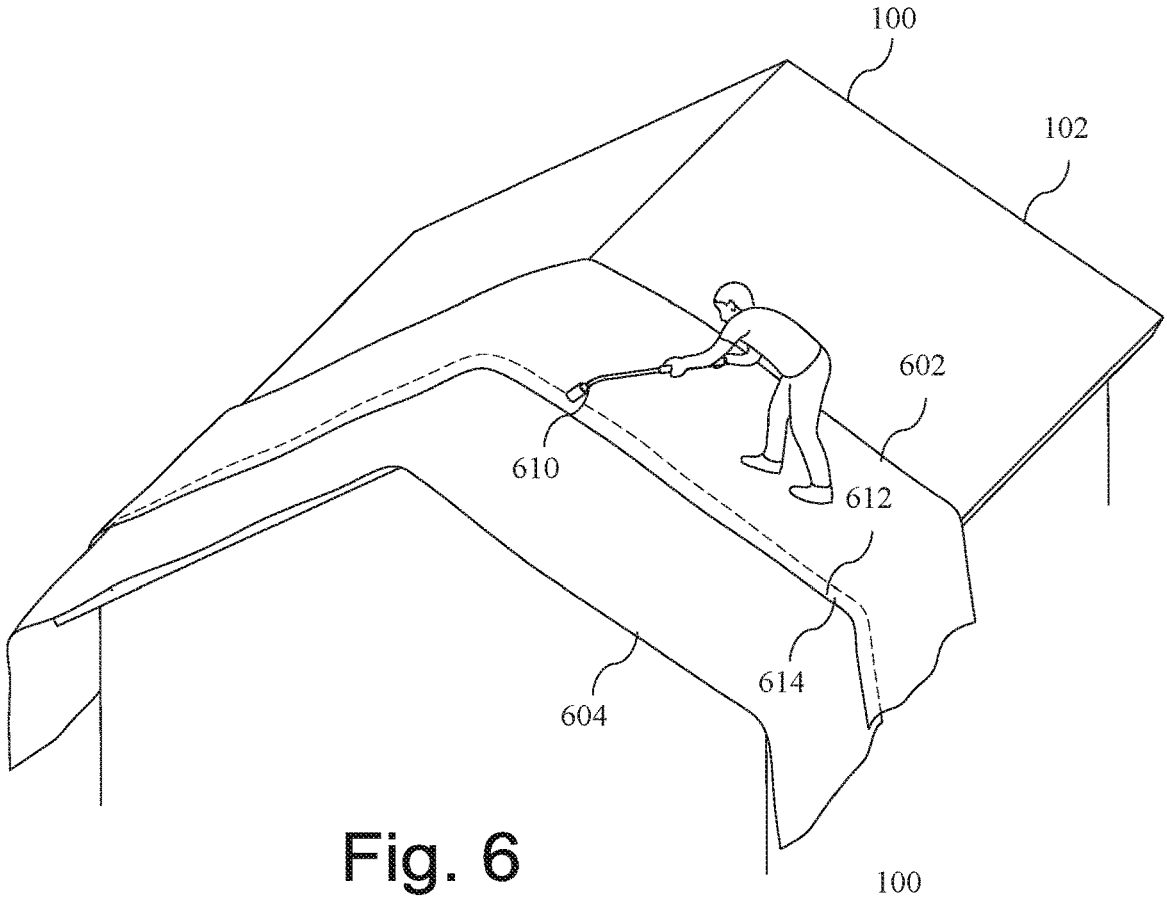
FIG. 6 is an illustration showing two strips of the impermeable membrane being fastened together using heat, as the proposed system and method for temporary protection of a damaged roof is applied, according to an example embodiment.

FIG. 6 is an illustration showing two strips 602, 604 of the impermeable membrane being fastened together using heat, as the proposed system and method for temporary protection of a damaged roof is applied, according to an example embodiment. Recall that the water impermeable membrane that may shrink when heat is applied. Namely, when heat is applied to the water impermeable membrane, the material shrinks tightly over whatever it is covering. Further, when heat is applied to the water impermeable membrane, the membrane may become partially liquid or tacky and may meld with a membrane of the same type. That is, when two pieces of said membrane are placed adjacent to one another and heat is applied, the two pieces of the membrane may meld together and become one integrated portion of water impermeable membrane. FIG. 6 shows that the sides 612, 614 of the two strips 602, 604 of the water impermeable membrane are placed such that that the sides of each strip overlap (by about 3 to 8 inches) with the sides of the adjacent strip of impermeable membrane. Subsequently, heat is applied to the overlapping portion of the sides of each strip using a blowtorch or other heat device 610. As a result, the sides 612, 614 of the two strips 602, 604 of the water impermeable membrane are melded together, thereby producing a seam that is also water impermeable.

Figure 7:
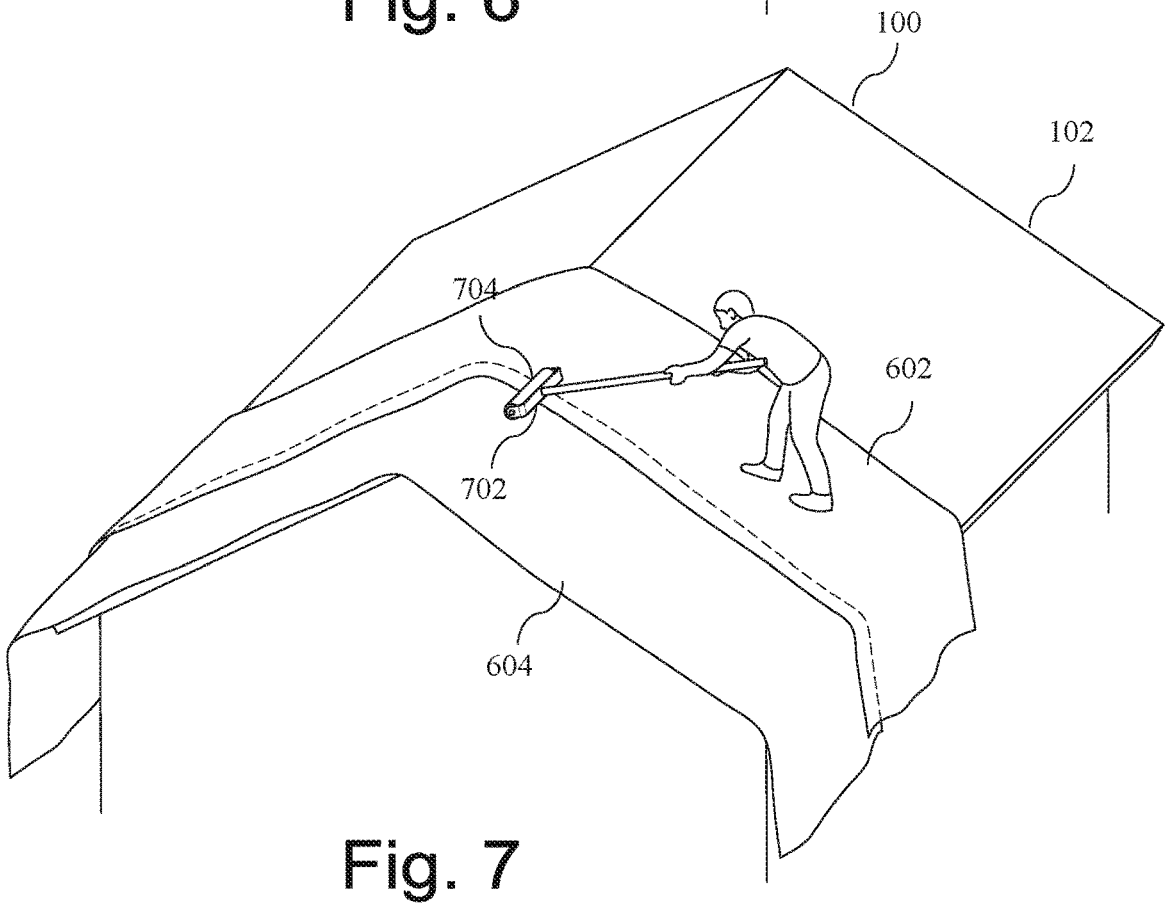
FIG. 7 is an illustration showing two strips of the impermeable membrane being fastened together using a roller device, as the proposed system and method for temporary protection of a damaged roof is applied, according to an example embodiment.

FIG. 7 is an illustration showing two strips 602, 604 of the impermeable membrane being fastened together using a roller device 702, as the proposed system and method for temporary protection of a damaged roof is applied, according to an example embodiment. FIG. 7 shows that the sides 612, 614 of the two strips 602, 604 of the water impermeable membrane were placed such that that the sides of each strip overlap and heat was applied to the overlapping portion so that the sides 612, 614 of the two strips 602, 604 of the water impermeable membrane were melded together, thereby producing a seam that is also water impermeable. FIG. 7 shows that a roller 702 is applied to the overlapping portion or seam so as to secure the sides 612, 614 of the two strips 602, 604 of the water impermeable membrane together. The roller 702 may comprise a cylinder 704 that rotates as it rolls over the overlapping portion, thereby patting down any bubbles or undulations in the overlapping portion. The purpose of applying the roller 702 is to flatten the overlapping portion or seam as much as possible, resulting in a stronger seam and a flatter surface that optimizes water runoff.

The roller 702 may comprise leather that has been placed over the cylinder 704. A Kevlar thread may be used to sew the leather onto the cylinder 704 of the roller 702. Said roller cover withstands high heat and allows users to fuse the sides or seams of the strips 602, 604 together.

Figure 8:
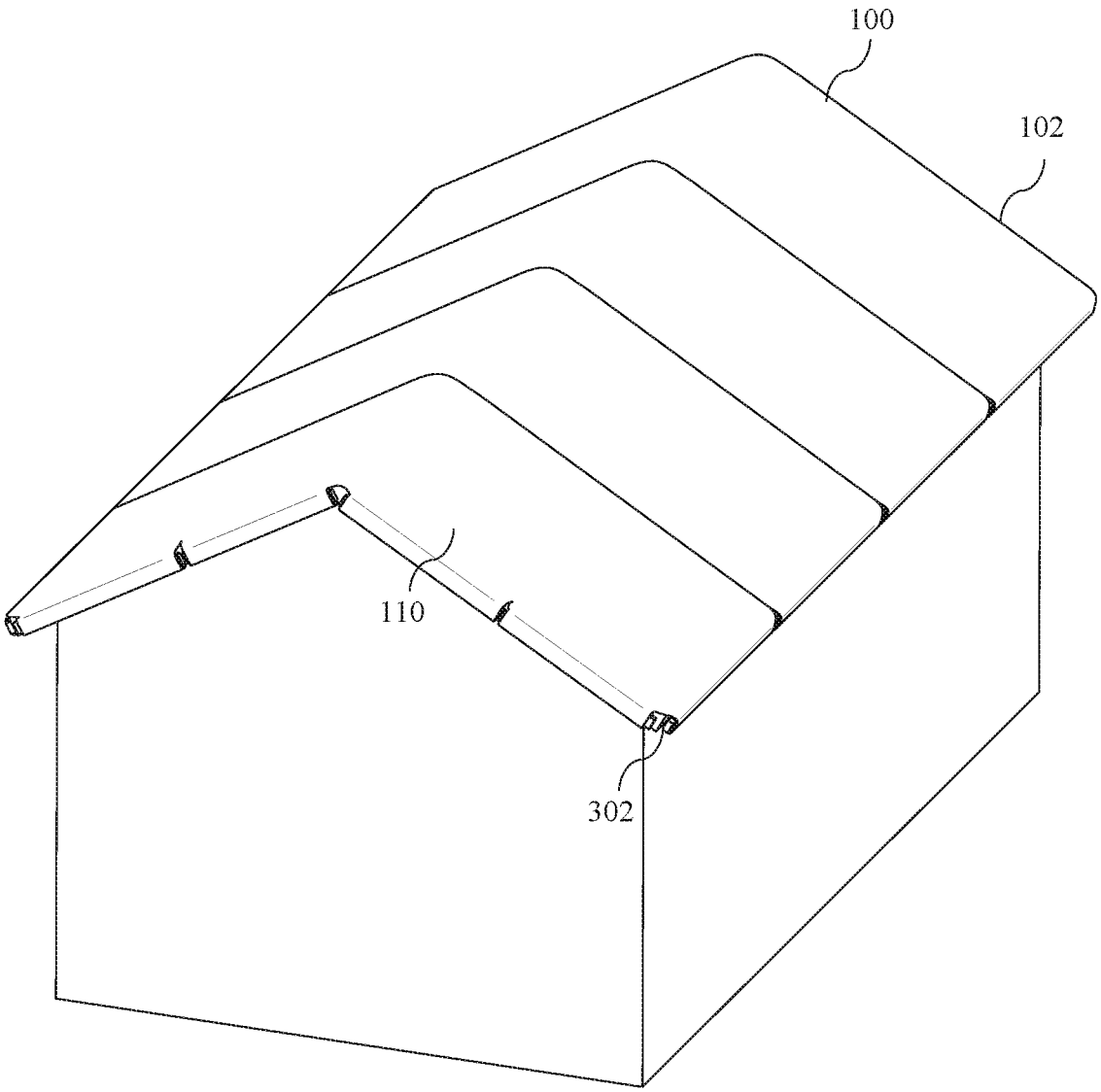
FIG. 8 is an illustration of a perspective view of the residential structure with a damaged roof, showing the proposed system and method for temporary protection of a damaged roof completely applied, according to an example embodiment.

FIG. 8 is an illustration of a perspective view of the residential structure 100 with a damaged roof 102, showing the proposed system and method for temporary protection of a damaged roof completely applied, according to an example embodiment. FIG. 8 shows that multiple rolls 110 of the impermeable membrane have been draped on top of the damaged roof 102 of the residential structure 100 in the same direction and the sides of each unrolled strip of impermeable membrane have been melded to adjacent unrolled strips of impermeable membrane, such that the entire roof is covered in the impermeable membrane. Finally, sandbags may be placed on top of the impermeable membrane that has been draped over the roof, in order to hold the impermeable membrane on top of the roof. FIG. 8 shows that the construction material 302 on the eaves of the roof has been wrapped in the end of the unrolled strip 202 in a clockwise direction so that the open end of the roll faces downwards. This reduces or eliminates the pooling of water in the open end of the roll.

Said process described above for waterproofing a structure can also be used to provide wall insulation for a wall of a structure, to provide dust barriers for a structure, to provide waterproofing of a structure during construction, to provide waterproofing of a structure under construction that is lacking exterior windows, doors and walls, and for containment of the interior of buildings. Said process described above for waterproofing a structure can also be used to provide a separation in the interior of buildings or warehouses for smaller temporary rooms for security or temperature control.

Figure 9:
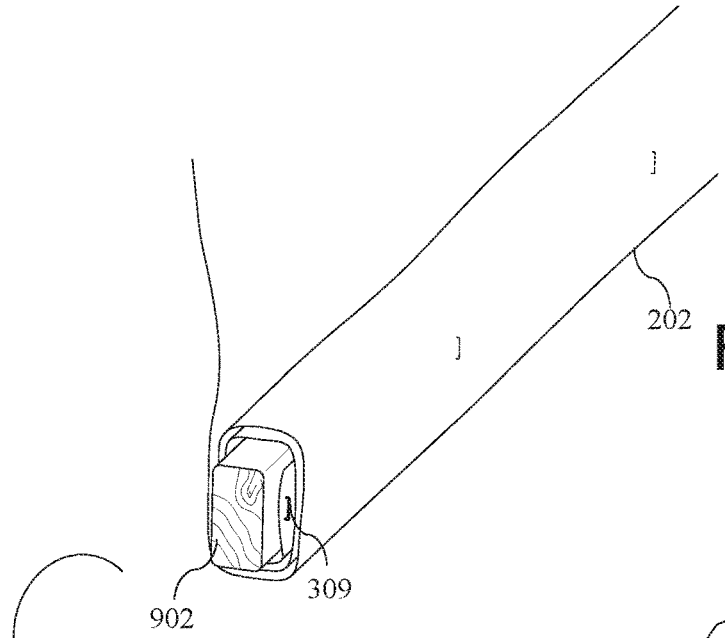
FIG. 9 is another illustration showing construction material in the process of being wrapped in the impermeable membrane, as the proposed system and method for temporary protection of a damaged roof is applied, according to an example embodiment.

FIG. 9 is another illustration showing construction material 902 in the process of being wrapped in the impermeable membrane 304, as the proposed system and method for temporary protection of a damaged roof is applied, according to an example embodiment. In FIG. 9, the construction material 902 is rolled in the end of the unrolled strip 202 in a counterclockwise direction 919 so that an open end of the roll faces upwards. FIG. 9 shows the roll 110 of impermeable membrane has been unrolled to such a length that the end of the unrolled strip 202 overhangs the eaves of the damaged roof 102 of the residential structure. FIG. 9 shows that the end of the unrolled strip 202 (which was rolled around the construction material 902) has been attached to the construction material 902 via a fastener 309, which is a staple.

Figure 10:
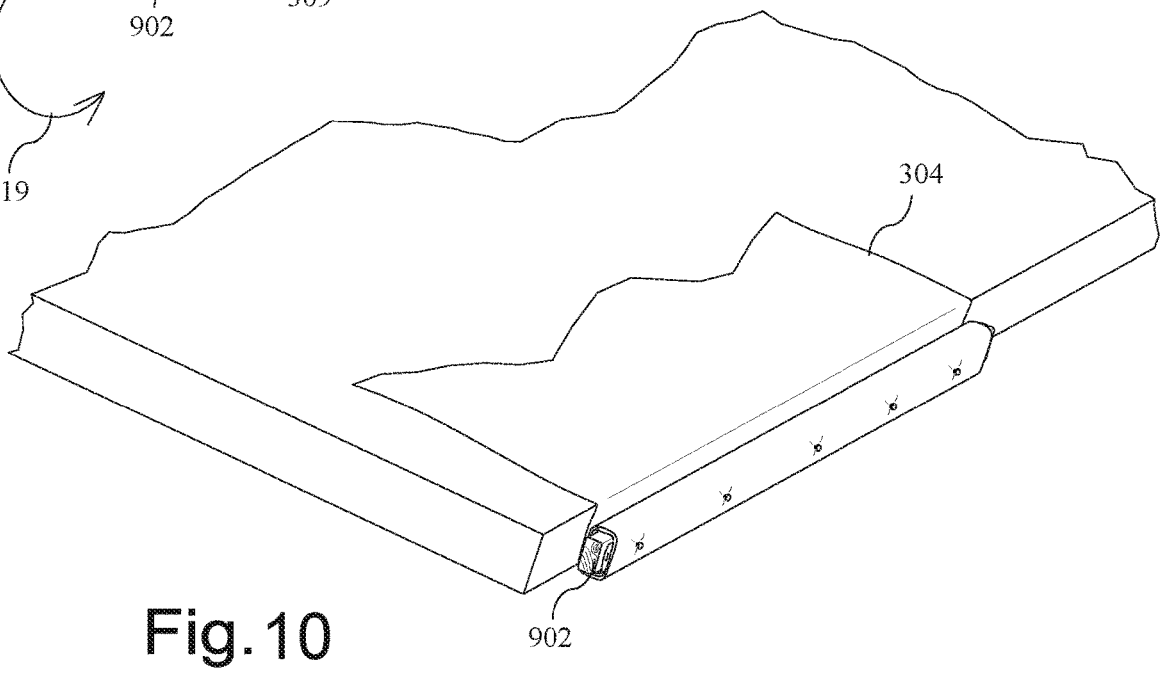
FIG. 10 is another illustration showing construction material completely wrapped in the impermeable membrane and attached to the damaged roof, as the proposed system and method for temporary protection of a damaged roof is applied, according to an example embodiment.

FIG. 10 is an illustration showing construction material 902 completely wrapped in the impermeable membrane 304 and attached to the damaged roof 102, as the proposed system and method for temporary protection of a damaged roof is applied, according to an example embodiment. Note that the construction material 902 is attached to the vertical, outward-facing fascia of the eaves of the roof. FIG. 10 shows that the construction material 902 has been wrapped in the end of the unrolled strip 202, which overhangs the eaves of the damaged roof 102.

In the event that attachment of the construction material 902 can't be made below the eaves of the roof, sandbags may be placed at the edge of the roof surface. Sandbags may be placed approximately 4-6' inside the edge of the strip of impermeable membrane 304 from the edges of the roof. The end of the strip of impermeable membrane 304 may be folded over the sandbags and the end of the strip of impermeable membrane 304 may be heat treated (as shown in FIG. 6), therefore encapsulating the sandbags. Sandbags may be placed every 15-20'. Once heated, the sandbags may be rolled one additional time on to itself to provide added support.

Figure 11:
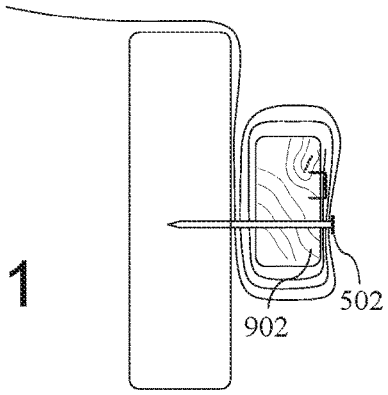
FIG. 11 is another illustration showing a cross-sectional view of construction material completely wrapped in the impermeable membrane and attached to the damaged roof, as the proposed system and method for temporary protection of a damaged roof is applied, according to an example embodiment.

FIG. 11 is an illustration showing a cross-sectional view of construction material 902 completely wrapped in the impermeable membrane 304 and attached to the fascia of the damaged roof 102, as the proposed system and method for temporary protection of a damaged roof is applied, according to an example embodiment. FIG. 11 shows that the construction material 902 has been wrapped in the end of the unrolled strip 202 in a counterclockwise direction so that the open end of the roll faces upwards. The construction material 902 may be wrapped such that the end of the unrolled strip 202 completely surrounds the construction material 1-time, 2-times or, alternatively, 3-4 times. I.e., in one embodiment, construction material 902 is wrapped 1-time, 2-times or, alternatively, 3-4 times in the end of the unrolled strip. FIG. 11 shows that the end of the unrolled strip 202 (after wrapping the construction material 902) has been attached to the construction material 902 via a nail 502.

Figure 12:
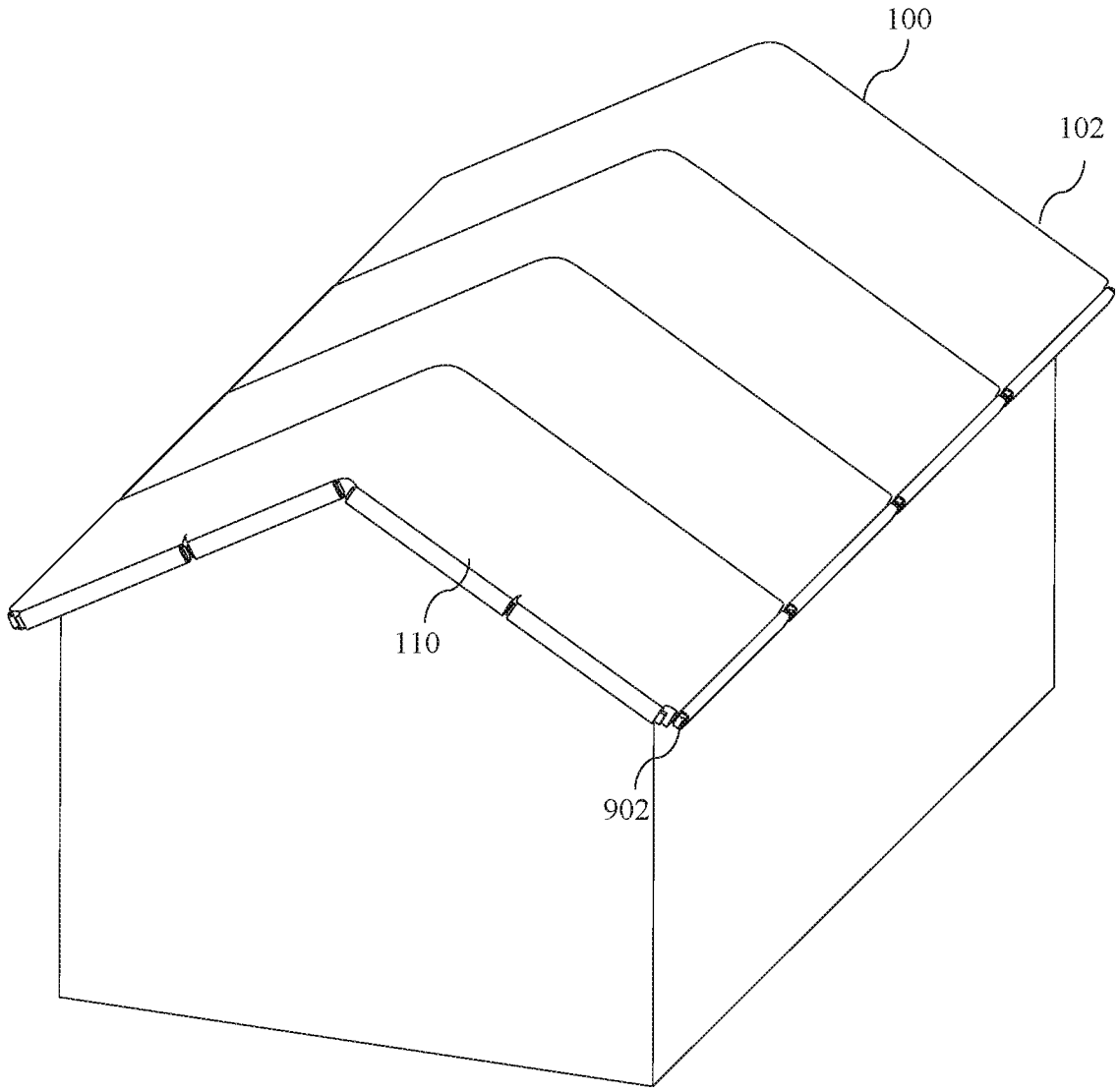
FIG. 12 is another illustration of a perspective view of the residential structure with a damaged roof, showing the proposed system and method for temporary protection of a damaged roof completely applied, according to an example embodiment.

FIG. 12 is another illustration of a perspective view of the residential structure 100 with a damaged roof 102, showing the proposed system and method for temporary protection of a damaged roof completely applied, according to an example embodiment. FIG. 12 shows that multiple rolls 110 of the impermeable membrane have been draped on top of the damaged roof 102 of the residential structure 100 in the same direction and the sides of each unrolled strip of impermeable membrane have been melded to adjacent unrolled strips of impermeable membrane, such that the entire roof is covered in the impermeable membrane. FIG. 12 shows that the construction material 902 on the eaves of the roof has been wrapped in the end of the unrolled strip 202 in a counterclockwise direction so that the open end of the roll faces upwards.

Figure 13:
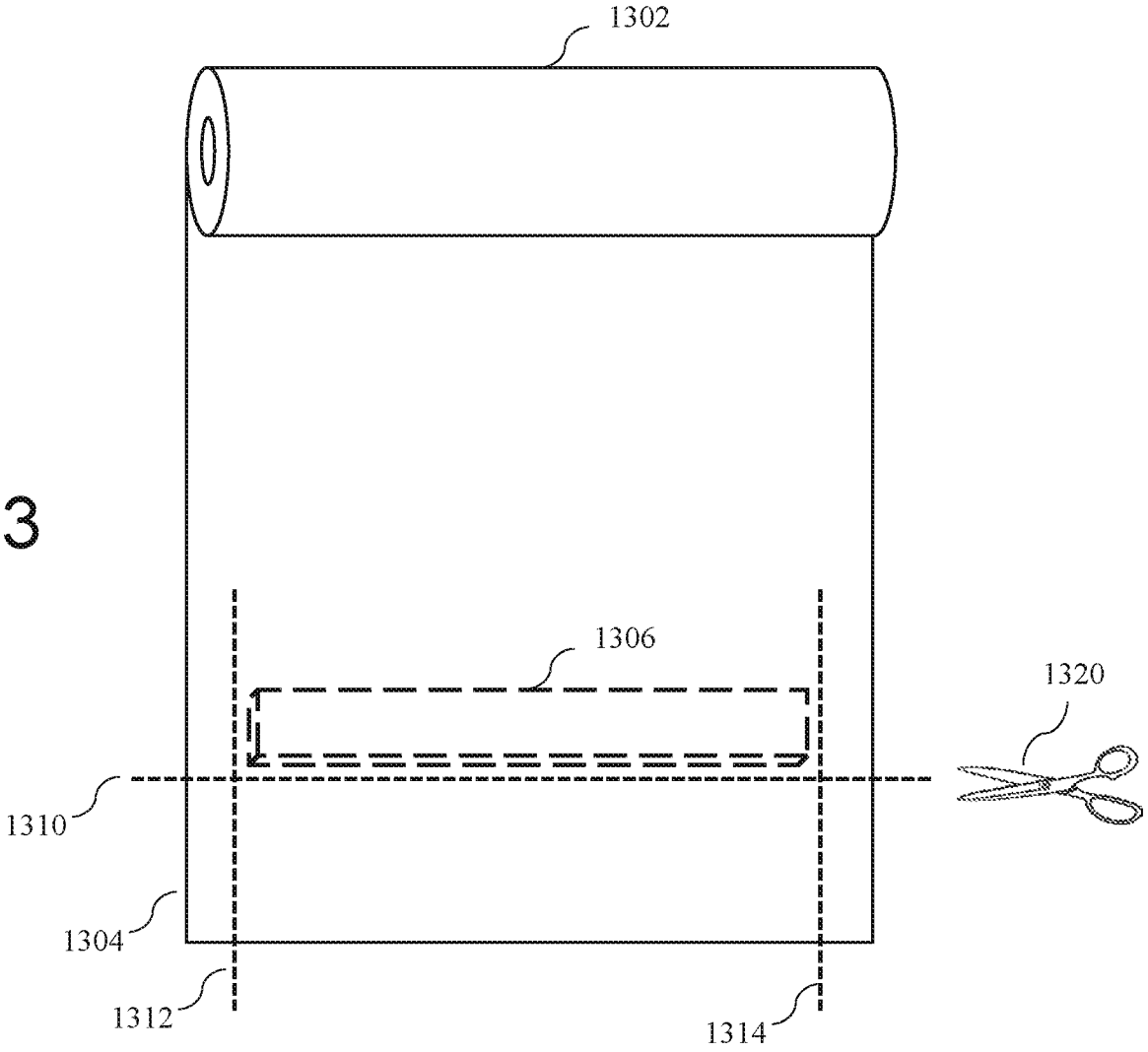
FIG. 13 is an illustration showing how an end of the strip of membrane is cut, according to an example embodiment.

FIG. 13 is an illustration showing how an end of the strip of membrane is cut, according to an example embodiment. In one embodiment, the method or process of attaching the ends of the unrolled strip 1304 to the eaves of the damaged roof 102 occurs as follows. A first unrolled strip 1304 of the impermeable membrane 1302 is draped over the roof 102, wherein the end of the strip overhangs the eaves of the roof. Then, a wood plank 1306 is placed horizontally under the end of the strip 1304 that overhangs the eaves of the roof, such that the wood plank is placed below the eaves of the roof. The wood plank is placed far enough below the eaves of the roof such that when the wood plank is rolled up in the end of the strip, the wood plank is at the height of the eaves of the roof.

Next, the right side of the strip 1304 is cut (using a cutting device, such as scissors 1320) vertically along a line 1314 to substantially match the length of the wood plank 1306. Said cut on the right side of the strip 1304 may be 6 inches long and may be placed at least one inch from the right side of the plank 1306. Also, the left side of the strip 1304 is cut vertically along a line 1312 to substantially match the length of the wood plank 1306. Said cut on the left side of the strip 1304 may be 6 inches long and may be placed at least one inch from the left side of the plank 1306. Next, the end of the strip 1304 is cut horizontally along a line 1310 below the wood plank 1306. Said cut may be placed flush with the bottom of the plank 1306, or may be placed at least one inch from the bottom of the plank 1306. Then, the wood plank is rolled in the strip 1304 as described above. Subsequently, the wood plank is fastened to the end of the strip using a plurality of staples. Next, the wood plank is rolled one full turn, two full turns, or three full turns in the end of the strip, such that the wood plank is at a height of the eaves of the roof. Then, the wood plank that was rolled in the end of the strip is attached to the eaves of the roof using a plurality of nails.

In an alternative embodiment where the construction material 302 is a flexible piece of plastic strip, the plastic strip is placed horizontally under the end of the membrane strip that overhangs the eaves of the roof, such that the plastic strip is placed below the eaves of the roof. The plastic strip is placed far enough below the eaves of the roof such that when the plastic strip is rolled up in the end of the membrane strip (described below), the plastic strip is at the height of the fascia of the eaves of the roof. The left and right sides of the membrane strip are not necessarily cut vertically. The end of the membrane strip may be cut horizontally below the plastic strip. That is, assuming the plastic strip is placed horizontally so that it is parallel with the eaves of the roof, a horizontal cut is placed in the end of the membrane strip below the plastic strip. There is no need to cut the membrane strip vertically because the plastic strip may be extended beyond the left and right edges of the membrane strip.

In an alternative embodiment where the construction material 302 is a flexible piece of plastic strip, a high-rise building attachment method is also disclosed. The process may begin on the second floor of the building, wherein a 2×4 wood plank is attached on an outside edge. Enough impermeable membrane is rolled out to extend to the bottom floor f the building with an extra door to make attachments. The flexible plastic strip is unrolled and attached to the outer most portion of the 2×4 using 2" screws. Then, the impermeable membrane is unrolled to the 1st floor. Next, on the 3rd floor of the building, a 2×4 wood plank is attached on an outside edge. Impermeable membrane is attached to the $3^{rd}$ floor and unrolled to the second floor. The flexible plastic strip is unrolled and attached to the outer most portion of the 2×4 of the $3^{rd}$ floor using 2" screws. Then, the impermeable membrane is unrolled to the 2nd floor. The ends of the impermeable membrane on the $2^{nd}$ floor are attached to the outer most portion of the 2×4 using 2" screws. This process is repeated for the entire high-rise.

Embodiments may be described above with reference to functions or acts, which comprise methods. The functions/acts noted above may occur out of the order as shown or described. For example, two functions/acts shown or described in succession may in fact be executed substantially concurrently or the functions/acts may sometimes be executed in the reverse order, depending upon the functionality/acts involved. While certain embodiments have been described, other embodiments may exist. Further, the disclosed methods' functions/acts may be modified in any manner, including by reordering functions/acts and/or inserting or deleting functions/acts, without departing from the spirit of the claimed subject matter.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A method for covering a roof with an impermeable membrane, comprising:

a) draping a strip of the impermeable membrane over the roof, wherein an end of the strip overhangs a fascia of the eaves of the roof;

b) placing a rigid, elongated piece of construction material in a horizontal position under the end of the strip that overhangs the fascia of the eaves of the roof, such that the construction material is placed below the fascia of the eaves of the roof;

c) cutting the end of the strip as follows: 1) a horizontal cut below a position of the construction material, 2) a vertical cut to the left of the construction material, and 3) a vertical cut to the right of the construction material, such that a resulting shape of the end of the strip is substantially commensurate with the construction material;

d) fastening the construction material to the end of the strip using a plurality of first fasteners;

e) rolling the construction material at least one full turn in the end of the strip that overhangs the fascia of the eaves of the roof;

f) attaching the construction material that was rolled in the end of the strip to the fascia of the eaves of the roof using a plurality of second fasteners; and g) repeating steps a) through f) until the entire roof is covered in the impermeable membrane.

2. The method of claim 1, further comprising:

h) overlapping at least three inches of a first strip of the impermeable membrane that has been draped over the roof with a second strip of the impermeable membrane that has been draped over the roof.

3. The method of claim 2, further comprising:

i) applying heat using a heat source to a portion of the first strip that overlaps the second strip, so as to meld the portion of the first strip with the second strip, and applying heat using said heat source to the entire impermeable membrane, so as to shrink the entire impermeable membrane.

4. The method of claim 3, further comprising:

j) placing sandbags on top of the impermeable membrane that has been draped over the roof, in order to hold the impermeable membrane on top of the roof.

5. The method of claim 4, wherein the rigid, elongated piece of construction material comprises a wood plank.

6. The method of claim 5, wherein the first fasteners comprise staples.

7. The method of claim 6, wherein the second fasteners comprise nails.

8. A method for covering a roof with an impermeable membrane, comprising:

a) draping a strip of the impermeable membrane over the roof, wherein an end of the strip overhangs a fascia of eaves of the roof;

b) placing a rigid, elongated piece of construction material in a horizontal position under the end of the strip that overhangs the fascia of the eaves of the roof, such that the construction material is placed below the fascia of the eaves of the roof;

c) cutting the end of the strip as follows: 1) a horizontal cut below a position of the construction material, 2) a vertical cut to the left of the construction material, and 3) a vertical cut to the right of the construction material, such that a resulting shape of the end of the strip is substantially commensurate with the construction material;

d) fastening the construction material to the end of the strip using a plurality of staples;

e) rolling the construction material at least one full turn in the end of the strip that overhangs the fascia of the eaves of the roof;

f) attaching the construction material that was rolled in the end of the strip to the fascia of the eaves of the roof using a plurality of screws; and g) repeating steps a) through f) until the entire roof is covered in the impermeable membrane.

9. The method of claim 8, further comprising:

h) overlapping at least three inches of a first strip of the impermeable membrane that has been draped over the roof with a second strip of the impermeable membrane that has been draped over the roof.

10. The method of claim 9, further comprising:

i) applying heat using a heat source to a portion of the first strip that overlaps the second strip, so as to meld the portion of the first strip with the second strip, and applying heat using said heat source to the entire impermeable membrane, so as to shrink the entire impermeable membrane.

11. The method of claim 10, further comprising:

j) placing sandbags on top of the impermeable membrane that has been draped over the roof, in order to hold the impermeable membrane on top of the roof.

12. The method of claim 4, wherein the rigid, elongated piece of construction material comprises a wood plank.

13. A method for covering a roof with an impermeable membrane, comprising:

a) draping a strip of the impermeable membrane over the roof, wherein an end of the strip overhangs a fascia of eaves of the roof;

b) placing a flexible strip of construction material in a horizontal position under the end of the strip that overhangs the fascia of the eaves of the roof, such that the construction material is placed below the fascia of the eaves of the roof;

c) cutting the end of the strip as follows: a horizontal cut below a position of the construction material;

d) fastening the construction material to the end of the strip using a plurality of first fasteners;

e) rolling the construction material at least one full turn in the end of the strip that overhangs the fascia of the eaves of the roof;

f) attaching the construction material that was rolled in the end of the strip to the fascia of the eaves of the roof using a plurality of second fasteners; and g) repeating steps a) through f) until the entire roof is covered in the impermeable membrane.

14. The method of claim 13, further comprising:

h) overlapping at least three inches of a first strip of the impermeable membrane that has been draped over the roof with a second strip of the impermeable membrane that has been draped over the roof.

15. The method of claim 14, further comprising:

i) applying heat using a heat source to a portion of the first strip that overlaps the second strip, so as to meld the portion of the first strip with the second strip, and applying heat using said heat source to the entire impermeable membrane, so as to shrink the entire impermeable membrane.

16. The method of claim 15, further comprising:

j) placing sandbags on top of the impermeable membrane that has been draped over the roof, in order to hold the impermeable membrane on top of the roof.

17. The method of claim 16, wherein the construction material comprises a flexible plastic strip available in a coiled form.

18. The method of claim 17, wherein the first fasteners comprise staples.

19. The method of claim 18, wherein the second fasteners comprise nails.

* * * * *